US008360758B2

(12) United States Patent
Cheng

(10) Patent No.: US 8,360,758 B2
(45) Date of Patent: Jan. 29, 2013

(54) PERISTALTIC PUMP

(76) Inventor: Zaijun Cheng, Shenzhen (CN)

( * ) Notice: Subject to any disclaimer, the term of this patent is extended or adjusted under 35 U.S.C. 154(b) by 416 days.

(21) Appl. No.: 12/589,211

(22) Filed: Oct. 19, 2009

(65) Prior Publication Data

US 2010/0047098 A1 Feb. 25, 2010

Related U.S. Application Data

(62) Division of application No. 10/592,104, filed as application No. PCT/CN2005/000288 on Mar. 9, 2005, now Pat. No. 7,625,189.

(30) Foreign Application Priority Data

Mar. 10, 2004 (CN) ..... 2004 1 0008362

(51) Int. Cl.
*F04B 43/12* (2006.01)

(52) U.S. Cl. ..... 417/477.7; 417/477.1; 417/476; 417/474

(58) Field of Classification Search ..... 417/474, 417/476, 477.1, 477.7
See application file for complete search history.

(56) References Cited

U.S. PATENT DOCUMENTS

| | | | | |
|---|---|---|---|---|
| 4,070,725 | A * | 1/1978 | Cornelius et al. | 417/236 |
| 5,484,239 | A * | 1/1996 | Chapman et al. | 417/477.8 |
| 5,741,125 | A * | 4/1998 | Neftel et al. | 417/477.7 |
| 7,011,387 | B2 * | 3/2006 | Saito et al. | 347/29 |
| 7,591,639 | B2 * | 9/2009 | Kent | 417/477.8 |
| 2003/0169312 | A1 * | 9/2003 | Ota et al. | 347/29 |

* cited by examiner

*Primary Examiner* — Charles Freay
*Assistant Examiner* — Christopher Bobish
(74) *Attorney, Agent, or Firm* — Raymond Y. Chan; David and Raymond Patent Firm

(57) ABSTRACT

A peristaltic pump, for propelling liquid through a flexible pump tube, includes an outer casing having a guiding channel wherein an operating portion of the pump tube extends along the guiding channel. The peristaltic pump further includes at least two pressuring rollers supported at the outer casing in a radially movable manner which can move outwardly to press against the operating portion of the pump tube. A center driving mechanism is supported at a center portion of the outer casing to radially push the pressure rollers and to drive the pressuring rollers to concurrently rotate such that the pressuring rollers roll against the operating portion of the pump tube for continuously propelling the fluid in the pump tube in the direction of rotation.

8 Claims, 3 Drawing Sheets

PERISTALTIC PUMP

CROSS REFERENCE OF RELATED APPLICATION

This is a Divisional application of a non-provisional application having an application Ser. No. 10/592,104 and a filing date of Sep. 7, 2006 now U.S. Pat. No. 7,625,189, which is the national application of PCT application number PCT/CN2005/000288 filed Mar. 9, 2005 in which priority of application number 200410008362.1 filed on Mar. 10, 2004 is claimed.

BACKGROUND OF THE PRESENT INVENTION

1. Field of Invention

The present invention relates to a pump for propelling liquid through a flexible tube segment, and more particularly to a peristaltic pump for propelling liquid through the flexible tube in a concealed manner to ensure the purity of the liquid during transmission and to prevent an environmental pollution of the peristaltic pump.

2. Description of Related Arts

The peristaltic pump is commonly used as a safe and stable liquid pumping device in many different fields such as the medical, pharmaceutical, chemical, nuclear, aviation, and environmental industries.

Nowadays, conventional peristaltic pumps usually comprise an outer casing, a flexible pump tube which is adapted for allowing fluid to flow therealong, a plurality of rotating rollers spacedly supported at the outer casing at equal radial distance. The rotating rollers exert pressure on the pump tube thus to propel the liquid. A negative pressure will then be formed when the pump tube returns to it normal position so ask to suck in fluid from the source and thus continuously propel the fluid to travel in the pump tube. There are many disadvantages for such a conventional peristaltic pump. For examples, the peristaltic pump enclosed in China Patent CN85204827 and CN87107936 uses the rotating rollers to only exert pressure on the pump tube in a particular arc section of the guiding channel so as to achieve a more convenient installation of the pump tube. As a result, the design will experience a radial pulsing force on a particular section of the pump tube and also faces the following problems that are hard to overcome:

1. a high power motor is required to drive the machine to overcome the friction on the particular side, especially for the initial force and the torque, therefore it increases the size of the machine, i.e. the bigger size of driving shaft and the power of the motor, and the design has a low efficiency;

2. the machine is easy to wear out, a special design is needed to suit for the machine in order to keep a desired pressure and displacement exerted by the rollers on the pump tube; and 3. the machine is noisy.

SUMMARY OF THE PRESENT INVENTION

The technical problem that the present invention seeks to solve is to provide a peristaltic pump that is accurate in pumping fluid, cost efficient, low manufactory cost, convenient to repair and minimize the noise level of the machine.

Accordingly, in order to solve the above technical problems, the present invention provides a peristaltic pump comprises an outer casing that has at least one guiding channel, at least one flexible pump tube installed inside the guiding channel, at least two pressuring rollers which is driven by a center driving mechanism. The pump tube has an operating portion and circulates the guiding channel more than one full circle. The pressuring rollers are supported at the circular edge of the center driving mechanism and are driven by the center driving mechanism to rotate and exert pressure on the operating portion of the pump tube thus pumping the fluid along the pump tube.

As an embodiment of the present invention, the center driving mechanism comprises a driving shaft capable of rotating to drive the pressuring rollers, a retainer which is used to retain and support the pressuring rollers, at least a driving plate which can rotate as the same manner as the driving shaft, and a plurality of peripheral indentions formed on outer edges of the driving plates so that the pressuring rollers can be received at the peripheral indention.

According to the present invention, the retainer comprises at least one pedal. A pedal slot is formed at one of the driving plates as a starting plate that the pedal is engaged with the pedal slot. The center driving mechanism comprises at least two driving plates including the starting plate, preferably three or above. The number of the driving plates excluding the starting plate should preferably come in pairs so as to keep symmetry of the center driving mechanism. Accordingly, the center driving mechanism can be constructed to have a plurality set of driving plates that one set of the driving plates is formed as the starting plate. The starting plate can be a single plate structure and should be positioned at the center between other driving plates. The thickness of the single starting plate could be double the thickness of the other driving plates. The pedal slot of the starting plate matches the size of the pedal. The pedal slots of the other driving plates extends along it arc length which is adapted to be driven by the pedal in a predetermined order of the driving plates. A corner of the peripheral indention of the starting plate can be formed in a roundness manner to the outer diameter by making the edge tangent to the outer diameter such that the edge of the peripheral indention is smoothly and gradually extended from the bottom side of the peripheral indention to the outer edge of the starting plate.

In addition, the retainer is used to the distance between the pressuring rollers. The retainer further comprises a retainer shaft protrudes out from two sides of the pressuring roller and engages within a retainer slot of the retainer so that the pressuring roller can be supported firmly and its distance between the pump tube and the driving plates can be retained.

The total thickness of the driving plates should be equal to the length of the pressuring roller and is approximate two times the width of the compressed pump tube. The peripheral indentions are equally spacedly installed at the outer edges of the driving plates and have a corresponding pressuring roller to engage with. The depth and shape of the aligned peripheral indentions of the driving plates should correspond to diameter size of the pump tube so that the pump tube is allowed to recover to its original shape when the pressuring roller is engaged with the peripheral indention of the starting plate.

The outer casing of the peristaltic pump can comprise a plurality of guiding channel wherein each guiding channel has one single pump tube. As an alternative, the outer casing of the peristaltic pump comprises only a single guiding channel but capable to have multiple pump tubes installed within.

The advantage of the present invention is that the peristaltic pump has a full complete circle of propelling path for the pump tube to propel liquid. Since it is a full circle and the pressuring rollers are evenly distributed all around, the force of the pressuring rollers can couple with each other and thus minimize the problem of getting a single stressed area in the peristaltic pump. The pressure exerted on the pump tube are also evenly distributed along the full circle thus to provide a more accurate and stable propelling motion. The present invention can minimize the noise as well as manufacturing and repairing cost of the peristaltic pump. When the peristaltic pump is not in used, the pressuring rollers can receive in the peripheral indention so that the pump tube will not be receiving unnecessary pressure. And the design makes the installation and tuning of the pump tube easier and is suitable for various types of pump tubes.

A main object of the present invention is to provide a peristaltic pump for propelling liquid through a flexible tube segment which is very stable and accurate in propelling liquid while the noise from the peristaltic pump can be minimized.

Another object of the present invention is to provide a peristaltic pump for propelling liquid through a flexible tube segment which is very energy efficient.

Another object of the present invention is to provide a peristaltic pump for propelling liquid through a flexible tube segment without exerting pressure on the tube when installing the tube into the peristaltic pump in the beginning of the operation so as to simplify the operation of peristaltic pump and to prevent pump tube being aged when the pressure continuously exerts at the pump tube while being unused.

Another object of the present invention is to provide a peristaltic pump for propelling liquid through a flexible tube segment which does not involve complicated mechanical structure, so as to minimize the manufacturing and repairing cost of the peristaltic pump.

Another object of the present invention is to provide a peristaltic pump for propelling liquid through a flexible tube segment which minimizes the noise effectively.

Accordingly, in order to accomplish the above objects, the present invention provides a peristaltic pump for propelling liquid through a flexible tube segment comprising:

an outer casing having a guiding channel and defining a whole circular path therealong;

a flexible pump tube, which is adapted for allowing the liquid flowing therealong, having an operating portion extending along the guiding channel of the outer casing fully;

at least two pressuring rollers spacedly and eccentrically supported at the outer casing in a radially movable manner; wherein the two pressuring rollers are radially and outwardly moved to press against the operating portion of the pump tube along the circular path;

a center driving mechanism supported at a center portion of the outer casing to radially push the pressure rollers and to drive the pressuring rollers to concurrently rotate such that the pressuring rollers roll against the operating portion of the pump tube for continuously propelling the fluid in the pump tube in the direction of rotation.

These and other objectives, features, and advantages of the present invention will become apparent from the following detailed description, the accompanying drawings, and the appended claims.

DETAILED DESCRIPTION OF THE PREFERRED EMBODIMENT

Figure 1:
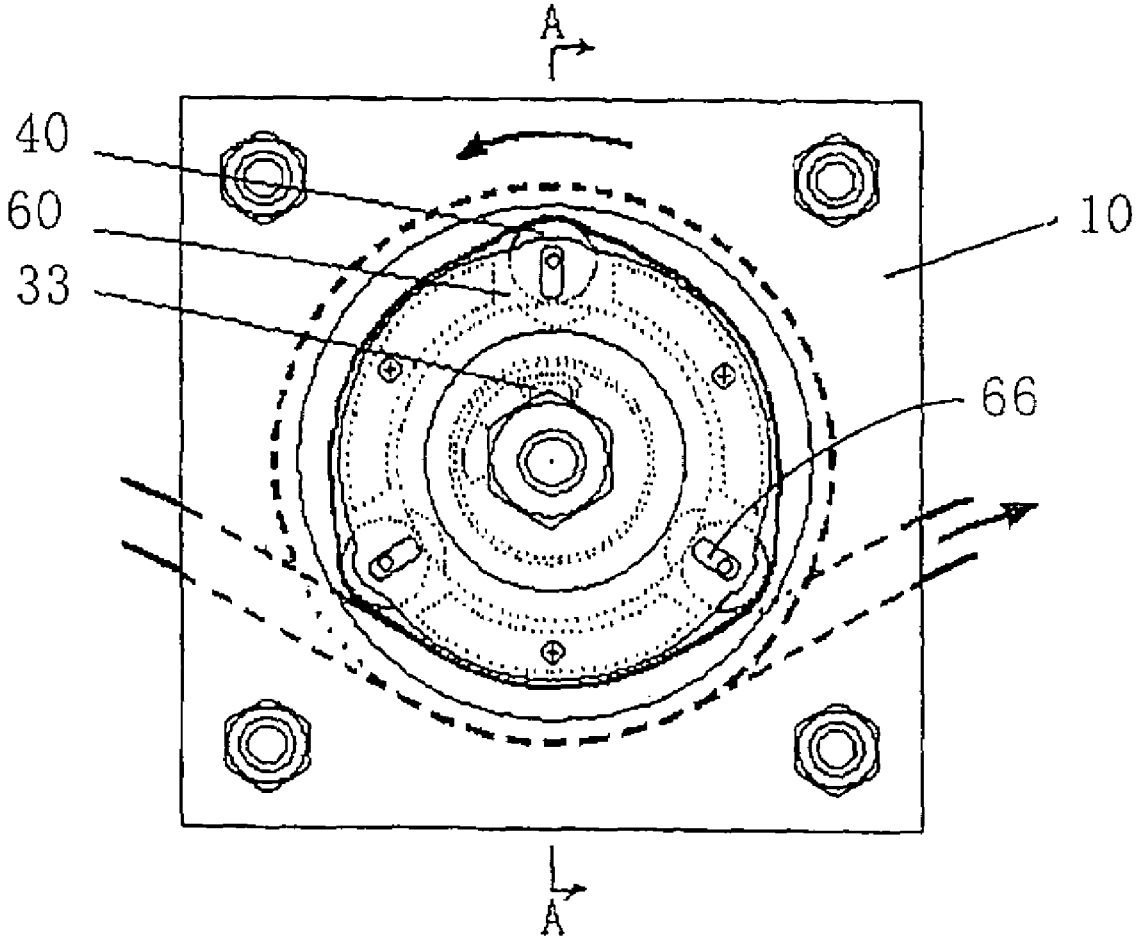
FIG. 1 is a top sectional view of the peristaltic pump according to a preferred embodiment of the present invention.
Figure 2:
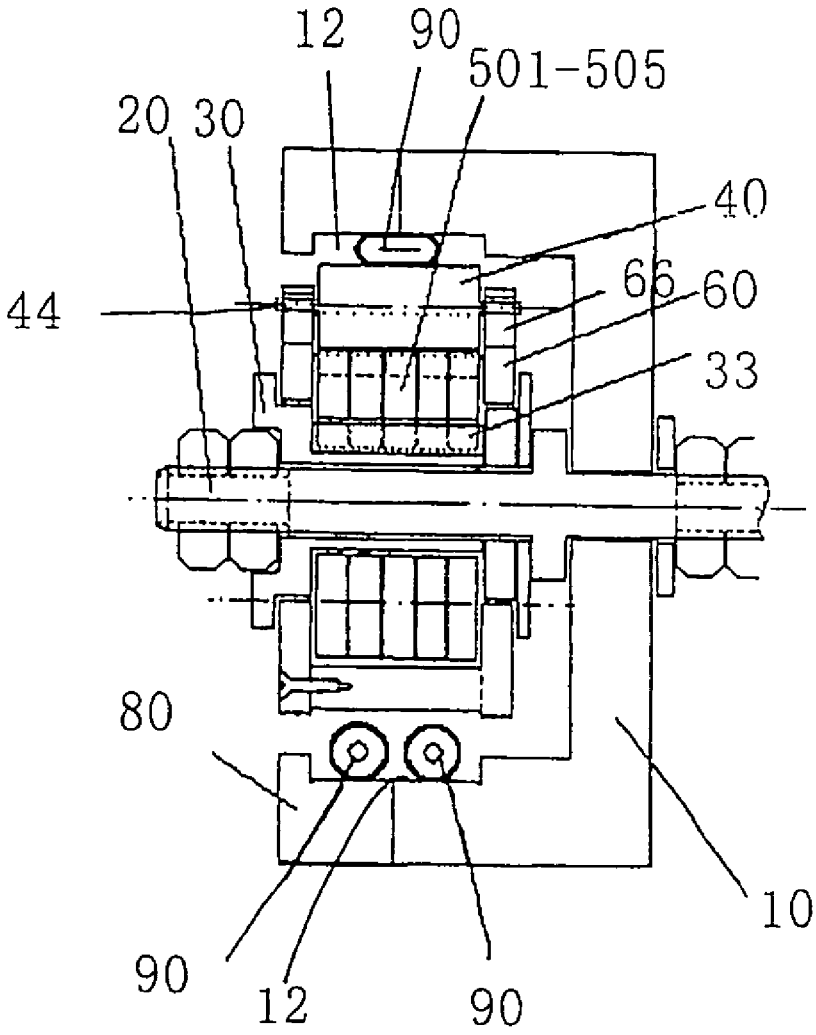
FIG. 2 is a side sectional view of the peristaltic pump according to the above preferred embodiment of the present invention.

Referring to FIG. 1 and FIG. 2 of the drawings, the peristaltic pump comprises an outer casing 10, a center driving mechanism, at least two pressuring rollers 40, a retainer 60, and a flexible pump tube 90. The outer casing 10 has a guiding channel 12 formed along an inner wall of the outer casing 10 and defines a circular path therealong, a center driving mechanism supported at a center portion of the outer casing 10. There are pressuring rollers 40 spacedly and eccentrically supported at the outer casing 10. The retainer 60 is used to retain and support the pressuring roller 40. The flexible pump tube 90 made of silicon, which is adapted for allowing the liquid flowing therealong, has an operating portion extending along the guiding channel 12 of the outer casing 10. Accordingly, the pressuring rollers 40 are symmetrically and planetary supported at the outer casing 10 in a radially movable manner. The center driving mechanism comprises a motor which drives a driving shaft 20. A transmission unit 30 comprises a cylindrical driving element, wherein a pedal 33 protrudes out from an outer surface of the driving element, and a plurality of driving plates 501, 502, 503, 504, and 505 in an overlapped manner. According to the preferred embodiment of the present invention, there are five driving plates 501-505.

Figure 3:
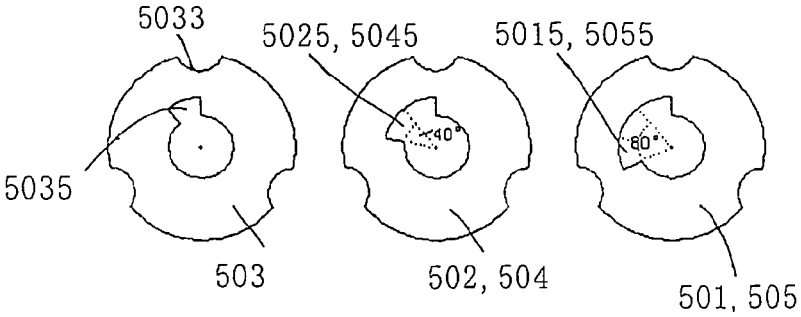
FIG. 3 is a front view of the driving plate of the transmission unit according to the above preferred embodiment of the present invention illustrating their peripheral indention and pedal slots.

Referring to FIG. 3 of the drawings of the preferred embodiment, the first to fifth driving plates 501-505 are very similar in a circular structure. The third driving plate 503, which is also regarded as a middle starting plate, has three peripheral indentions 5033 in an arc shape evenly formed at the circumferential edge of the third driving plate 503. The center portion of the third driving plate 503 has a pedal slot 5035. The third driving plate 503 has a predetermined diameter that the third driving plate 503 is adapted to push the pressuring roller 40 to substantially press against the pump tube 90 within the guiding channel 12. The depth and shape of the peripheral indention 5033 of the third driving plate 503 should correspond to diameter size of the pump tube 90 so that the pump tube 90 is allowed to recover to its original shape when the pressuring roller 40 is engaged with the peripheral indention 5033 of the third driving plate 503. In other words, the radius of the peripheral indention 5033 is slightly larger than the radius of the pressuring roller 40 so as to allow the pump tube 90 not being pressed within the guiding channel 12 when the pressuring roller 40 is located at the peripheral indention 5033. Accordingly, all five driving plates 501-505 have the same structure of the peripheral indentions. The difference between the five driving plates 501-505 is the size of the pedal slot. The arc length of the pedal slot 5035 of the third driving plate 503 is the same arc length of the pedal 33 such that the pedal 33 can be fitted into the pedal slot 5035 of the third driving plate 503. In other words, the size and the shape of the pedal 33 of the transmission unit 30 is fitted right into pedal slot 5035 of the driving plate 503. The third driving plate 503 is sandwiched between the identical second and fourth driving plates 502, 504, wherein the arc length of the pedal slot 5025, 5045 of each of the second and fourth driving plates 502, 504 is larger than the arc length of the pedal slot 5035 of the third driving plate 503. Preferably, arc length of the pedal slot 5025, 5045 of each of the second and fourth driving plates 502, 504 is additional 400 of the arc length of the pedal slot 5035 of the third driving plate 503. In other words, the arc length of the pedal slot 5025, 5045 of each of the second and fourth driving plates 502, 504 is additional 40° extending at the operation direction, i.e. the rotational direction of each of the second and fourth driving plates 502, 504. The second, third, and fourth driving plates 502, 503, 504 are sandwiched between the identical first and fifth driving plates 501, 505. In other words, the first and fifth driving plates 501, 505 are the two outer plates. The arc length of the pedal slot 5015, 5055 of each of the first and fifth driving plates 501, 505 is larger than the arc length of the pedal slot 5025, 5045 of each of the second and fourth driving plates 502, 504. Preferably, arc length of the pedal slot 5015, 5055 of each of the first and fifth driving plates 501, 505 is additional 80° of the arc length of the pedal slot 5035 of the third driving plate 503. In other words, the arc length of the pedal slot 5015, 5055 of each of the first and fifth driving plates 501, 505 is 80° extending at the operation direction, i.e. the rotational direction of each of the first and fifth driving plates 501, 505.

The transmission unit 30 is connected to the driving shaft 20. The driving plates 501-505 are overlappedly combined together to engage with the transmission unit 30 that the pedal slots 5015, 5025, 5035, 5045, and 5055 are coaxially aligned with each other. The pedal 33 of the driving element engages the pedal slots 5015, 5025, 5035, 5045, 5055 of the driving plates 501-505 such that when the driving element is driven to rotate by the driving shaft 20, the driving plates 501-505 are driven to rotate subsequently by the pedal 33.

Figure 4:
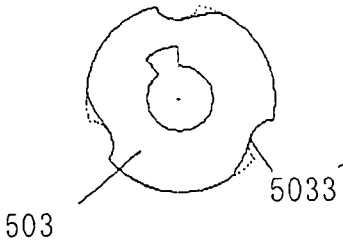
FIG. 4 illustrates an alternative mode of the starting plate according to the above preferred embodiment of the present invention.

The peripheral indentions as shown in FIG. 3 all have sharp corners. FIG. 4 illustrates an alternative mode of the peripheral indention wherein a corner of the peripheral indention 5033 of the third driving plate 503 can be modified as a round corner as shown by the dotted line which tangents out with the outer diameter of the driving plate 503. The second and third driving plates 502 504 can follow the same modification as the third driving plate 503 to minimize the clearance of the driving plates 501-505 when the peripheral indentions of the driving plates 501-505 are misaligned to form an arc surface. This modification does not affect the operation of the invention. All driving plates 501-505 have the same thickness which their combined thickness is equal to the width of the pressuring roller 40 and is approximately equal to two times of the width of the pressured pump tube 90.

The pressuring roller 40 has a diameter of approximately 2.5-3 times of the depth of the pump tube 90 needed to be compressed. A width of the pressure roller 40 is approximately two times of the width of the compressed pump tube 90. A retainer shaft 44 protrudes out from two sides of the pressuring roller 40 and engages within a retainer slot 66 of the retainer 60 so that the pressuring roller 40 can be supported firmly and its distance between the pump tube 90 and the driving plates 501-505 can be retained.

According to the preferred embodiment of the present invention, the retainer 60 also helps to keep a predetermined distance between the pressuring rollers 40 but it does not affect the rotation and radial movement of them. Accordingly, a movable connecting rod can be installed in between the pressuring roller 40 and the retainer 60. A central axis of both sides of the pressuring roller 40 can be connected to an end of the connecting rod. This structural configuration does not affect the operation of the invention also.

The outer casing 10 has the guiding channel 12 formed along the inner side of the peripheral wall of the outer casing 10 and defines the circular path therealong. According to the preferred embodiment of the present invention, the pump tube 90 is installed in a full spiral manner in the guiding channel 12 of the outer casing 10. An installation space is required for inserting the pump tube 90 into the guiding channel 12 of the outer casing 10. In other words, a width of the guiding channel 12 is approximately about two times the width of the compressed pump tube 90 when the pump tube 90 is pressed by the pressuring roller 40 along the guiding channel 12. Furthermore, the pump tube 90 is tangentially extended into the outer casing 10 at an entrance of the guiding channel 12 until the operating portion of the pump tube 90 is received along the circular path of the guiding channel 12. In addition, the operating portion of the pump tube 90 is retained in an arc shape within the guiding channel 12 while the guiding portion of the pump tube 90, i.e. extending from the operating portion thereof, is tangentially extended with respect to the outer casing 10. Therefore, the configuration of the pump tube 90 with respect to the outer casing 10 allows the liquid to flow in a maximized circular distance with respect to the circumference of the outer casing 10 such that when the pressuring rollers 40 substantially press against the pump tube 90, the liquid is forced to flow along the arc-shaped operating portion of the pump tube 90 within the circular path at 120° so as to cancel the pulsation of the liquid within the pump tube 90.

If the peripheral wall of the outer casing 10 is too slippery, then the pump tube 90 might have a slight movement along the guiding channel 12 while in operation. A plate can be installed at an entrance or exit location of the pump tube 90 in the peripheral wall to limit the slight movement of the pump tube 90 along the guiding channel 12. As an alternative, the peripheral wall of the guiding channel 12 can be formed as a rough surface to enhance the friction of the pump tube 90 against the peripheral wall so as to avoid the movement along the guiding channel 12.

The operation principle of the present invention is explained below in detail:

In a release state when the driving shaft 20 is not rotating, the peripheral indentions of the all driving plates 501-505 are all aligned to each other so that a full arc indention surface is formed at the peripheral side of the combined driving plates 501-505. The pressuring roller 40 can then be fitted to engage the peripheral indentions of the driving plates 501-505 at a position that the circumferential surface of the pressuring roller 40 is engaged with the indention surface of the driving plates 501-505. The pump tube 90 can be installed now and there will not be any pressure exerted onto the operating portion of the pump tube 90. When the driving shaft 20 starts to rotate in the operating direction, it will drive the transmission unit 30 to rotate as well. The pedal 33 of the driving element of the transmission unit 30 will first engage the pedal slot 5035 of the driving plate 503 because the pedal slot 5035 is the narrowest out of the five driving plates 501-505 and thus drive the driving plate 503 to rotate in the operating direction as well. Once this motion starts, the peripheral indentions 5033 of the driving plates 501-505 will not be aligned to each other forming a full arc shape and thus disengage the peripheral indentions of the driving plates 501-505 from the pressuring roller 40. At this point, the pressuring roller 40 is then forced to radially extend towards the peripheral wall of the outer casing 10 and thus exerts a pressure on the pump tube 90. When the driving shaft 20 reaches a 40° rotation in the operating direction, the pedal 33 of the driving element of the transmission unit 30 will then engage the pedal slots 5025, 5045 of the second and fourth driving plates 502, 504 and thus drive the second and fourth driving plates 502, 504 to rotate. When the driving shaft 20 rotates an extra 40° in the operating direction, the pedal 33 of the driving element of the transmission unit 30 will then engage the pedal slots 5015, 5055 of the first and fifth driving plates 501, 505 and thus drive the first and fifth driving plates 501, 505 to rotate. At this moment, the peripheral indentions of each of the driving plates 501-505 will not be aligned and thus no indention or arc will be formed from the combined driving plate 501-505. Therefore, as long as the driving shaft 20 keeps rotating in the operating direction or does not rotating in a reverse direction until a predetermined degree of rotation, the peripheral indentions of the driving plates 501-505 will never be aligned with each other, thus the pressuring roller 40 will always be exerting pressure onto the operating portion of the pump tube 90. Following the procedure above, the fluid in the pump tube 90 will be forced to be pumped thus fulfilling to role of the peristaltic pump. When the machine is not in use, rotate the driving shaft 20 in the reverse direction less than 180° and the peripheral indentions of the driving plates 501-505 will be aligned on top with each other again. Since the pump tube 90 itself is flexible and elastic in it self-nature, it will push back onto the pressuring roller 40 and thus forcing the pressuring roller to engage the aligned peripheral indentions of the driving plates 501-505 and the present invention to return to the release state.

Referring to FIG. 2 of the drawings, the outer casing 10 further comprises an opening cover 80 which can be opened so as to make ease for the removal of the pump tube 90 and the center driving mechanism for repairing and such.

Figure 5:
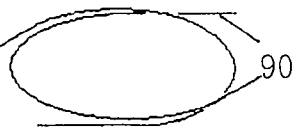
FIG. 5 illustrates a configuration of the present invention using two pump tubes.
Figure 6:
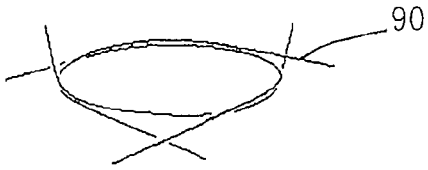
FIG. 6 illustrates a configuration of the present invention using three pump tubes.

Referring to FIG. 5 and FIG. 6 of the drawings, using the same principle for operating the present invention, multiple pump tubes 90 can be used in the present invention. The pump tubes 90 can be installed inside the guiding channel 12 of the outer casing 10 in a similar manner as described above. Multiple pump tubes 90 can be used as long as the pump tubes 90 are installed in a full circle manner around the peristaltic pump and have at least one of the pressuring rollers to be exerting pressure on the operating portion of the pump tube 90. FIG. 5 illustrates a configuration of the present invention using two pump tubes 90. FIG. 6 illustrates a configuration of the present invention using three pump tubes 90. Using the same principle for operating the present invention, for example, a combined total number of 3 and 7 pieces of driving plates will also work in the same manner as described in the preferred embodiment as well as long as they are symmetrically installed on each sides of the driving plate in the middle. It is even possible to use only two driving plates to carry out the function of a five pieces driving plates 501-505 as described in the preferred embodiment. Thus, the driving plates 501-505 of the transmission unit 30 are not limited by their numbers as long as an angle of the pedal slot of the driving plate correlates to a desired situation.

Figure 7:
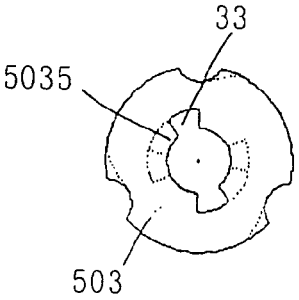
FIG. 7 illustrates another alternative of the present invention which the driving plate has two pedal slots.

Referring to FIG. 7 of the drawings, an alternative of the driving plates 501-505 of the present invention is illustrated. Using the driving plate 503 as example, the pedal slot 5035 can have a duplicated exact mirror feature of itself by rotating 180°. Therefore the pedal slot 5035 of the driving plate 503 is now double-sided. A similar principle modification is applied to the pedal 33 of the driving element of the transmission unit 30 so as to increase the contact area between the pedal 33 and pedal slot 5035 and thus creates a more stable and efficient rotation of the transmission unit 33.

Referring to the preferred embodiment of the present invention, the pressuring roller 40 and the drifting shaft 20 are made of metallic materials. Other parts are made of plexiglass. The peripheral wall of the guiding channel 12 of the outer casing 10 is lathed in a single cut from a two layer plexiglass. The entrance and exit location of the pump tube 90 can be milled from a milling machine and then the opening cover 80 of the outer casing 10 can be installed firmly thereon by screws.

Figure 8:
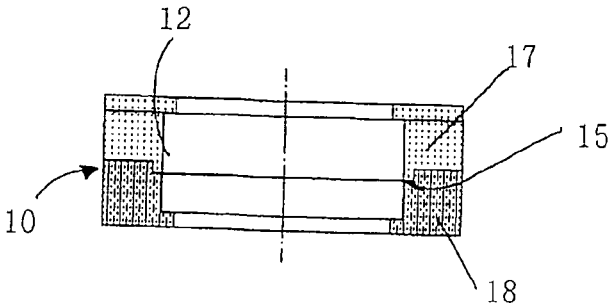
FIG. 8 is a side view of the outer casing illustrating that it is divided into the upper layer and the lower layer and is capable of rotating for ease of tuning and installation.

Referring to FIG. 8 of the drawings, the present invention can also be produced in mass production by a casting of industrial plastic and similar materials. The outer casing 10 can be split into an upper housing 17 and a lower housing 18. In between the upper housing 17 and lower housing 18, an edge 15 is defined at a joint area so that the upper housing 17 can be fittedly received inside the lower housing 18 and screws can be used to joint them. Since multiple pump tubes 90 or different brand or material of pump tubes 90 can be used in the present invention, the flexible pump tube 90 can reflect a different pressure back on the pressuring roller 40. The upper housing 17 and the lower housing 18 can now rotate concentrically in an independent manner so as to offer an option for tuning the angles or a routing route of installing pump tubes 90 into the guiding channel 12 of the outer casing 10.

One skilled in the art will understand that the embodiment of the present invention on as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A peristaltic pump, comprising an outer casing, at least a flexible pump tube adapted for allowing a liquid flowing therethrough, two or more pressuring rollers, and a center driving mechanism, said outer casing having a circular guiding channel formed along an inner side of a peripheral wall of said outer casing to define a circular path therealong, said flexible pump tube having a circular operating portion installed in said circular guiding channel, said circular operating portion of said flexible pump tube circulating and extending around said guiding channel for at least one full circle forming a full circle operating portion along said circular path for said peristaltic pump, said center driving mechanism comprising a driving shaft and a transmission unit, said driving shaft being capable of being driven to rotate at a center portion of said outer casing, said transmission unit being connected to said driving shaft, said pressuring rollers being spacedly, eccentrically, symmetrically, and planetary supported between said operating portion of said flexible pump tube and said center driving mechanism in a radially movable manner, wherein said pressuring rollers are retained and supported to evenly distribute all around and to rolling about an outer circular edge of said center driving mechanism and are driven by said transmission unit of said center driving mechanism to rotate and exert pressure on said operating portion of said flexible pump tube when said driving shaft is driven to rotate in an operating direction, wherein said operating portion of said flexible pump tube is a full circle and said pressuring rollers are evenly distributed all around and rolling about said center driving mechanism in a planetary manner, and thus said full circle operating portion of said flexible pump tube provides a full complete circle of propelling path for said flexible pump tube so as to enable said pressuring rollers to provide continuous pressure on said operating portion of said flexible pump tube respectively by said center driving mechanism for propelling said liquid flowing through said flexible pump tube, thereby said center driving mechanism is adapted to be driven by said driving shaft to switch between an operation state and a pressure release state automatically with respect to a rotating direction of said driving shaft, wherein in said operation state, said center driving mechanism is driven by said driving shaft to rotate in said operating direction to provide a pressure against said operating portion of said flexible pump tube, and that in said release state, said center driving mechanism is able to be driven by said driving shaft in a reverse direction to release said pressure against said operating portion of said flexible pump tube, wherein said driving shaft has a pedal protruded out from an outer surface thereof and said transmission unit comprises two or more driving plates in an overlapped manner, wherein one of said driving plates is a starting plate and each of said driving plates has one or more peripheral indentions, which are evenly formed at a circumferential edge thereof and shaped adapted for said pressuring rollers to be received thereat, and a pedal slot provided at a center portion thereof, wherein said pedal slot of said starting plate is sized and shaped with respect to said pedal of said driving shaft, and said pedal slot of each of said other driving plates has an arc length longer than that of said pedal slot of said starting plate, wherein said pedal slots of said other driving plates extend along said arc lengths thereof at said operating direction of rotation of said driving shaft and are adapted to be driven by said pedal of said driving shaft in a predetermined order of said driving plates, wherein, in said release state, when said driving shaft is not rotating, said peripheral indentions of all of said driving plates are aligned with each other for receiving said pressuring rollers respectively, wherein when said driving shaft keeps rotating in said operating direction, said peripheral indentions of all of said driving plates would never be aligned with each other and thus said pressuring rollers are always be exerting pressure onto said operating portion of said flexible pump tube respectively and continuously.

2. The peristaltic pump, as recited in claim 1, wherein said starting plate is different from said other driving plates in that a corner of each of said peripheral indentions of said starting plate is formed in a roundness manner to an outer diameter by making an edge tangent to said outer diameter such that an edge of said peripheral indention is smoothly and gradually extended from a bottom side of said peripheral indention to said outer edge of said starting plate, wherein when driving shaft is driven to rotate at said operating direction, said starting plate rotates earlier than said other driving plates to push said pressuring roller to substantially press against said flexible pump tube within said guiding channel.

3. A peristaltic pump, comprising an outer casing, at least a flexible pump tube adapted for allowing a liquid flowing therethrough, two or more pressuring rollers, and a center driving mechanism, said outer casing having a circular guiding channel formed along an inner side of a peripheral wall of said outer casing to define a circular path therealong, said flexible pump tube having a circular operating portion installed in said circular guiding channel, said circular operating portion of said flexible pump tube circulating and extending around said guiding channel for at least one full circle forming a full circle operating portion along said circular path for said peristaltic pump, said center driving mechanism comprising a driving shaft and a transmission unit, said driving shaft being capable of being driven to rotate at a center portion of said outer casing, said transmission unit being connected to said driving shaft, said pressuring rollers being spacedly, eccentrically, symmetrically, and planetary supported between said operating portion of said flexible pump tube and said center driving mechanism in a radially movable manner, wherein said pressuring rollers are retained and supported to evenly distribute all around and to rolling about an outer circular edge of said center driving mechanism and are driven by said transmission unit of said center driving mechanism to rotate and exert pressure on said operating portion of said flexible pump tube when said driving shaft is driven to rotate in an operating direction, wherein said operating portion of said flexible pump tube is a full circle and said pressuring rollers are evenly distributed all around and rolling about said center driving mechanism in a planetary manner, and thus said full circle operating portion of said flexible pump tube provides a full complete circle of propelling path for said flexible pump tube so as to enable said pressuring rollers to provide continuous pressure on said operating portion of said flexible pump tube respectively by said center driving mechanism for propelling said liquid flowing through said flexible pump tube, thereby said center driving mechanism is adapted to be driven by said driving shaft to switch between an operation state and a pressure release state automatically with respect to a rotating direction of said driving shaft, wherein in said operation state, said center driving mechanism is driven by said driving shaft to rotate in said operating direction to provide a pressure against said operating portion of said flexible pump tube, and that in said release state, said center driving mechanism is able to be driven by said driving shaft in a reverse direction to release said pressure against said operating portion of said flexible pump tube, wherein said outer casing comprises a first housing and a second housing, wherein an edge is defined at a joint area between said first and second housings so that said first housing and said second housing are able to rotate concentrically in an independent manner to offer an option for tuning angles or a routing route of installing said flexible pump tube into said guiding channel of said outer casing.

4. The peristaltic pump, as recited in claim 1, wherein said driving shaft has another pedal protruded out from an outer surface thereof, wherein said two pedals are symmetrically arranged to have 180° therebetween, wherein said starting plate has another pedal slot sized and shaped with respect to said another pedal of said driving shaft.

5. A method for propelling liquid through a flexible pump tube by a peristaltic pump which comprises an outer casing, two or more pressuring rollers and a center driving mechanism rotatably installed in a center portion of said outer casing, wherein said outer casing has a circular guiding channel formed along an inner side of a peripheral wall of said outer casing to define a circular path therealong; wherein the method comprises the steps of:

(a) circulating and extending an operating portion of said flexible pump tube around said circular guiding channel for at least one full circle forming a full circle operating portion of said flexible pump tube for said peristaltic pump;

(b) supporting said pressuring rollers spacedly, eccentrically, symmetrically, and planetary to evenly distribute all around a circular edge of said center driving mechanism in a radially movable manner;

(c) driving said center driving mechanism to rotate in an operating direction;

(d) driving said pressuring rollers to roll around said center driving mechanism respectively, spacedly, symmetrically, concentrically, and planetary; and (e) pushing said pressuring rollers by said rotating center driving mechanism to substantially pressing against said operating portion of said flexible pump tube within said guiding channel continuously and respectively to propelling liquid through said flexible pump tube, wherein said center driving mechanism comprises a driving shaft and two more driving plates connected to said driving shaft in an overlapped manner, wherein one of said driving plates is a starting plate and each of said driving plates has one or more peripheral indentions, which are evenly formed at a circumferential edge thereof and shaped adapted for said pressuring rollers to be received thereat, wherein the step (a) further comprises the steps of:

(a1) when said driving shaft is not rotating, aligning all said peripheral indentions of said driving plates, including said starting plate, with each other to form a full arc indention surface;

(a2) engaging said pressuring rollers with said peripheral indentions at a position that circumferential surfaces of said pressuring rollers are engaged with said indention surfaces of said driving plates respectively; and (a3) installing said flexible pump tube in said guiding channel of said outer casing by circulating and extending said operating portion of said flexible pump tube around said circular guiding channel for at least one full circle to form said full circle operating portion of said flexible pump tube for said peristaltic pump while there is no pressure exerted by said pressuring rollers onto said operating portion of said flexible pump tube.

6. The method, as recited in claim 5, wherein the step (e) further comprises the steps of:

(e1) enabling said peripheral indentions of said driving plates, including said starting plate, being not be aligned with each other forming a full arc shape and thus disengaging said peripheral indentions of said driving plates from said pressuring rollers;

(e2) forcing said pressuring rollers to radially extend towards a peripheral wall of said outer casing while rolling about said center driving mechanism;

(e3) exerting a pressure on said full circle operating portion of said flexible pump tube, wherein as long as said driving shaft keeps rotating in said operating direction and does not rotating in a reverse direction until a predetermined degree of rotation, said peripheral indentions of said driving plates will never be aligned with each other, and thus ensuring said pressuring rollers always being exerting said pressure onto said operating portion of said flexible pump tube.

7. The method, as recited in claim 6, further comprising a step of:

(f) returning said pressuring rollers to a release state that no pressure is pressed against said operating portion of said flexible pump tube within said guiding channel by said pressuring rollers.

8. The method, as recite in claim 7, wherein the step (f) further comprises the steps of:

(f1) driving said driving shaft to rotate in a reverse direction;

(f2) aligning said peripheral indentions of said driving plates on top with each other; and (f3) pushing back onto said pressuring rollers by said operating portion of said flexible pump tube and forcing said pressuring rollers to engage with said aligned peripheral indentions of said driving plates.

* * * * *